US005350254A

United States Patent [19]

Fisk et al.

[11] Patent Number: 5,350,254

[45] Date of Patent: Sep. 27, 1994

[54] GUIDED MOLE

[75] Inventors: Allan T. Fisk, Needham; David I. Freed, Weston; Thomas H. Mann, Littleton, all of Mass.

[73] Assignee: Foster-Miller, Inc., Waltham, Mass.

[21] Appl. No.: 156,060

[22] Filed: Nov. 22, 1993

[51] Int. Cl.[5] ..... F16L 1/00

[52] U.S. Cl. ..... 405/184; 175/73; 405/154

[58] Field of Search ..... 405/154, 156, 184; 175/61, 62, 73–76, 19, 45

[56] References Cited

U.S. PATENT DOCUMENTS

| | | |
|---|---|---|
| 2,075,064 | 3/1937 | Schumacher et al. . |
| 2,153,680 | 4/1939 | Schumacher et al. . |
| 2,196,940 | 4/1940 | Potts . |
| 2,324,102 | 7/1943 | Miller et al. . |
| 2,350,986 | 6/1944 | Collins . |
| 2,686,660 | 8/1954 | Storm . |
| 2,873,092 | 2/1959 | Dwyer . |
| 2,903,239 | 8/1959 | Standridge . |
| 3,211,244 | 10/1965 | Cordary . |
| 3,419,091 | 12/1968 | Garnder . |
| 3,467,211 | 9/1969 | Goodwin et al. . |
| 3,525,405 | 8/1970 | Coyne et al. . |
| 3,712,391 | 1/1973 | Coyne . |
| 3,878,903 | 4/1975 | Cherrington . |
| 4,396,073 | 8/1983 | Reichman et al. . |
| 4,697,637 | 7/1987 | Cherrington et al. . |
| 4,714,118 | 12/1987 | Baker et al. . |
| 4,787,463 | 11/1988 | Geller et al. . |
| 4,834,193 | 5/1989 | Leitko et al. . |
| 4,858,704 | 8/1989 | McDonald et al. . |
| 4,867,255 | 9/1989 | Baker et al. . |
| 4,907,658 | 3/1990 | Stangl et al. . |
| 4,921,055 | 5/1990 | Kayes . |
| 4,953,638 | 9/1990 | Dunn . |
| 4,993,503 | 2/1991 | Fischer et al. . |
| 5,002,137 | 3/1991 | Kickinson et al. . |
| 5,163,520 | 11/1992 | Gibson et al. . |
| 5,255,749 | 10/1993 | Bumpuys et al. . |

FOREIGN PATENT DOCUMENTS

| | | |
|---|---|---|
| 2126267 | 3/1984 | United Kingdom . |

*Primary Examiner*—Dennis L. Taylor

*Attorney, Agent, or Firm*—Fish & Richardson

[57] ABSTRACT

Boring apparatus for forming a generally horizontal underground passage in soil for a utility conduit or the like that includes a tool head with a base portion and a nose portion mounted on the base portion. The base portion is rotatable relative to the nose portion between a first position in which nose portion surfaces are symmetrical with respect to the tool axis so that the tool will move along a straight path and a second position in which nose portion surfaces are in asymmetrical position with respect to the tool axis so that said tool will move along a curved path. By application of torque to the base portion, the base portion is shifted relative to the nose portion to shift the tool head from between an asymmetrical configuration and symmetrical configuration. Torque generating surface structure interacts with the soil and generates clockwise torque in one tool head position and counter clockwise torque in the other tool head position.

19 Claims, 2 Drawing Sheets

GUIDED MOLE

BACKGROUND OF THE INVENTION

This invention relates to methods and apparatus for boring underground horizontal passageways.

Horizontally bored underground passageways for pipe lines and utilities such as electrical distribution lines provide a safe, economical and environmentally responsible alternative to digging through or building over the natural terrain and man-made obstacles.

Pending U.S. application Ser. No. 938,819, filed Sep. 1, 1992 discloses improved moling apparatus for forming a generally horizontal underground passage in soil for a utility conduit or the like that includes tool head structure with a base portion and a nose portion mounted on the base portion. The base portion is rotatable relative to the nose portion between a first position in which nose portion surfaces are symmetrical with respect to the tool axis so that the tool will move along a generally straight path and a second position in which nose portion surfaces are in asymmetric position with respect to the tool axis so that the tool will move along a generally curved path. That guided mole is preferably maintained in the straight line moling mole (axisymmetric tool shape) by continuously applying a slight torque to an elongated torsionally stiff air supply hose such that the rotatable nose portion is maintained against an internal stop which defines the symmetric configuration of the tool. To shift from the straight line (axisymmetric) configuration to a steered (asymmetrical) configuration, the body portion is rotated relative to the nose portion (which tends not to rotate relative the soil) by application of torque through the air supply hose to the base portion. Random vibration under moling action produced by the pneumatic impact structure could cause the rotatable nose portion to wander relative to the body portion and such action would tend to cause the tool to steer in a somewhat unintended and unpredictable direction.

In accordance with one aspect of the invention, there is provided moling apparatus for forming a generally horizontal underground passage in soil for a utility conduit or the like which includes tool head structure with a base portion and a nose portion mounted on the base portion. The base portion is rotatable relative to the nose portion between a first position in which nose portion surfaces are symmetrical with respect to the tool axis so that the tool will move along a straight path and a second position in which nose portion surfaces are in asymmetrical position with respect to the tool axis so that the tool will move along the curved path. The apparatus includes structure which interacts with the soil to impart a torque in a first rotational direction when the nose portion is in the first position and torque in a second (opposite) rotational direction when the nose portion is in the second (asymmetrical) position with respect to the tool axis.

In a particular embodiment, the nose portion is mounted on the base portion for rotation about a swash axis that is at an angle to the tool axis, and the nose portion includes rib structure in the form of flanges with leading edge portions that are inclined relative to the tool axis and tend through interaction with the soil to impart a torque in a first rotational direction about the nose portion axis. The flanges also have different projected areas when the nose portion is in the second (asymmetric) position, that differential flange area tending to produce rotation of the nose portion in the opposite direction. These torquing conditions tend to maintain the mole in a first condition (symmetric or straight ahead) when the nose portion is in the first position and impart a torque in the opposite direction which tends to maintain the nose portion in the second (asymmetric) position when the nose portion is in that position. Thus, greater stability of the respective moling conditions is maintained as a function of the position of the mole system.

In the first position, the nose portion applies torque that tends to make the entire mole spiral through the soil as it advances along a straight line path. In the second position the nose portion applies torque in the opposite direction. A slight torque applied to the air hose when in the second position counteracts the spiraling tendency and holds the tool in the desired steering direction. The mole is shifted from its straight to its steering configuration by a strong torque applied through the torsionally resistant air hose to the base portion. Since the nose piece is engaged with the soil, the mole body to which the air hose is rigidly attached, will then rotate relative to the nose piece and to the soil as the tool advances. That action shifts the nose piece from a straight configuration to a steered configuration against a stop and vice versa. The torque and the rotational motion applied to the tool via air supply hose must be sufficient to overcome the tendency of the nose piece to spin or rotate in the same direction during the shift. In other words, during shift, the tool body must rotate more quickly than the nose piece tends to rotate under propeller action alone. In a particular embodiment, it is possible to rotate the tool body almost in place, with little or no advancement of the tool during shift, by reducing the air supply to the tool during shift and/or momentarily running the mole in reverse during shift.

In another particular embodiment, two torque generating ramp surfaces in the form of grooves are provided on the base portion, one torque generating ramp surface being exposed in the symmetric nose portion position and generating torque in a first rotational direction as the mole moves through the soil and the other torque generating ramp surface being exposed in the asymmetric nose portion position and generating torque in a second (opposite) rotational direction as the mole moves through the soil.

other features and advantages of the invention will be seen as the following description of particular embodiments progresses, in conjunction with the drawings, in which:

DESCRIPTION OF PARTICULAR EMBODIMENTS

Figure 1:
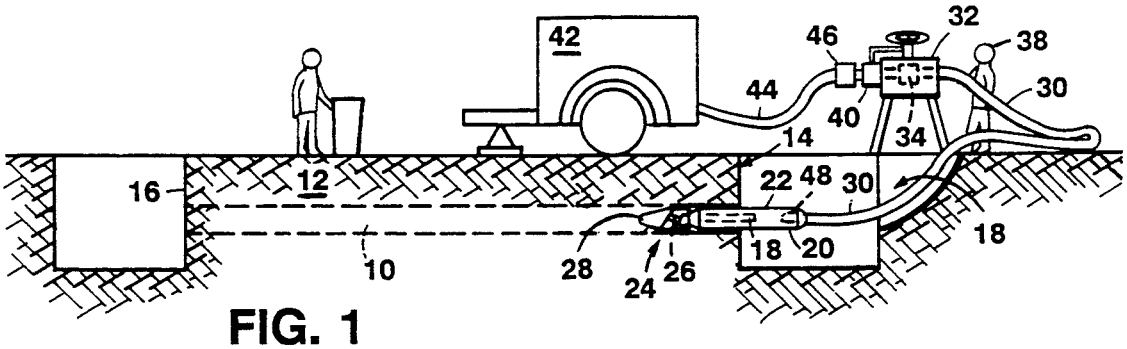
FIG. 1 is a diagrammatic view of horizontal boring apparatus according to the invention.

The schematic diagram of FIG. 1 shows a system for boring underground passageway 10 through strata 12 that may be relatively unconsolidated soil such as gravel for an electrical cable interconnection between launch pit 14 and target 16. The system includes mole 20 with body portion 22 that includes percussive (impact) mechanism 18 and head portion 24 that includes base portion 26 and nose portion 28. Coupled to mole 20 is torsionally stiff air hose 30 which follows mole 20 into bore passage 10 and thus must be slightly longer than the length of the intended bore passage. Torque controller 32 may be located near the launch point so that it need not be moved as mole 20 advances into bore passage 10. Torque controller 32 includes pneumatic controls familiar to those skilled in the art and may include a bidirectional (clockwise/counterclockwise) vane type air motor 34 with its output shaft rigidly affixed to air supply hose 30. The air motor shaft may be hollow, allowing supply air to be fed from inlet 40 of controller 32 through air motor 34 into hose 30. Suitable valving allows the operator 38 to adjust air pressure to the vane motor 34, an on/off air supply valve for the purpose of turning on and off the impact mechanism 18 in mole 20. Air compressor 42 supplies air over air supply hose 44 and a hose swivel 46 is provided so that the air supply hose 44 may simply lie on the ground and not rotate during moling operation. Mole 20 also houses transmitter 48. Further details of the moling system may be had with reference to copending application Ser. No. 938,819, filed Sep. 1, 1992, the disclosure entitled "GUIDED MOLE", the disclosure of which is specifically incorporated herein by reference.

With reference to FIGS. 2–5, mole head includes body portion 26 and nose section 28. The interface between the nose and base sections (surface 50 of nose portion 28 and surface 52 of base portion 26) forms a swash plane 54 that defines a swash axis 56 disposed at an angle of 15° to axis 58 of base portion 26. Further aspects of the interengagement of the base portion 26 and nose portion 28 may be had with reference to the above-mentioned pending application Ser. No. 938,819.

Nose piece 28 is of generally conical configuration and carries ribs 70, 76 that are offset 15° from swash axis 56. Rib 70 has bevelled leading surface 72 on the lower side of rib 70 and side edge surface 74 that is generally parallel to the side wall of nose portion 28. Rib 76 has a similar bevelled surface 80 on the upper side of rib 76 and a side wall surface 82 that extends generally parallel with axis 58.

Figure 5:
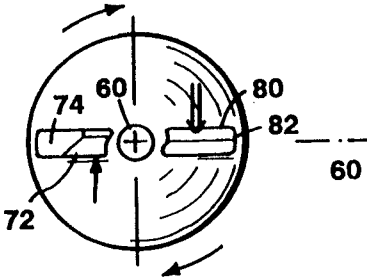
FIG. 5 is a front view of the boring head of FIG. 2.
Figure 9:
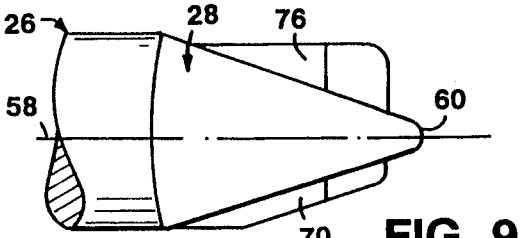
FIG. 9 is a top view of the boring head in the second position.
Figure 8:
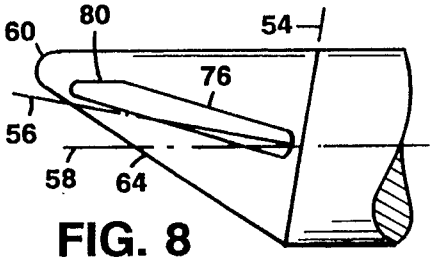
FIG. 8 is a right side view of the boring head in the second position.

FIGS. 2–5 show the base section 26 and nose piece 28 in straight moling configuration and FIGS. 6–9 are similar to corresponding views but show the mole in the second steered or asymmetric configuration. In the straight moling configuration shown in FIGS. 2–5, ribs 70 and 76 are aligned with tool axis 58, and bevel surfaces 72 and 80 produce a torque on nose piece 28 in the clockwise direction as indicated in FIG. 5 due to the interaction of soil on those surfaces as the mole 20 is advanced through the soil.

When the mole is shifted to the asymmetric or steered configuration shown in FIGS. 6–9 (by rotation of body 26 180° relative to nose portion 28 from one stop to a second stop) the angular orientation of nose portion 28 is shifted so that the angle between nose piece ribs 70, 76 and tool axis 58 becomes equal to twice the difference between the tool axis 58 and swash axis 56. In this position, tip 60 is offset from tool axis 58, nose surface 62 is parallel to axis 58 and surface 64 is at an angle of about 45° and ribs 70, 76 have their surfaces at about 30° (twice the swash angle) to tool axis 58. In this position, tool 20 will move through soil 12 along a curved path as the tool is propelled by impact mechanism 18 without rotation of body 26.

Figure 7:
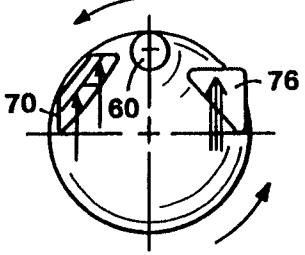
FIG. 7 is a front view of the boring head in the second position.
Figure 6:
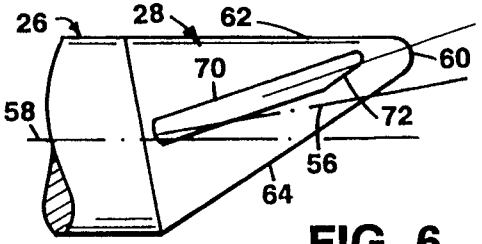
FIG. 6 is a left side view (similar to FIG. 3) of the boring head in a second or steering configuration position.

In this inclined (asymmetric) position of ribs 70, 76, the interaction of larger rib 76 with the soil is greater than the interaction of smaller rib 70 such that the resulting soil forces tend to rotate the nose piece in the counterclockwise direction as indicated in FIG. 7, the larger area of rib 76 having greater effect than the combined effect of the relatively smaller area of rib 70 and its bevelled surface 72.

Figure 12:
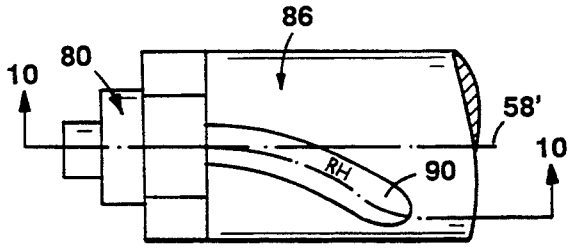
FIG. 12 is a top view of the boring head of FIG. 10.
Figure 11:
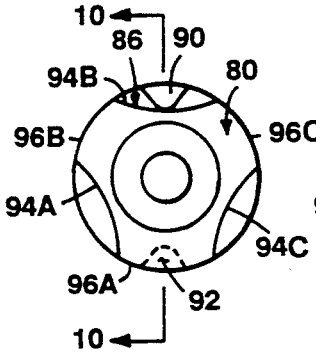
FIG. 11 is a front view of the boring head of FIG. 10.
Figure 10:
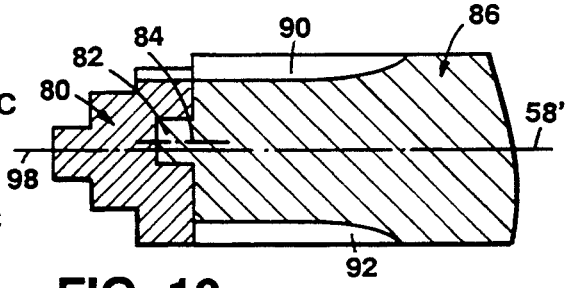
FIG. 10 is a side diagrammatic and partial sectional view (taken along the lines 10—10 of FIGS. 11 and 12) of another boring head embodiment for use in the system shown in FIG. 1.
Figure 15:
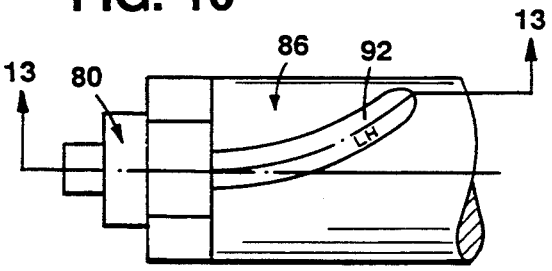
FIG. 15 is a top view of the boring head in the FIG. 12 position.
Figure 14:
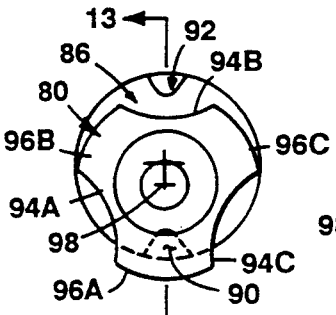
FIG. 14 is a front view of the boring head in the FIG. 12 position.
Figure 13:
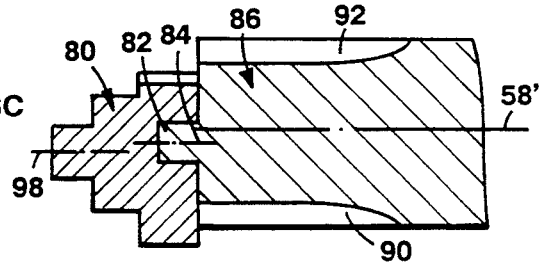
FIG. 13 is a view, similar to FIG. 10, showing that embodiment in a second position.
Figure 2:
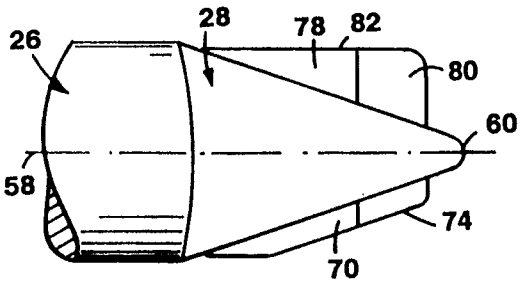
FIG. 2 is a top view of the boring head of the apparatus shown in FIG. 1.
Figure 3:
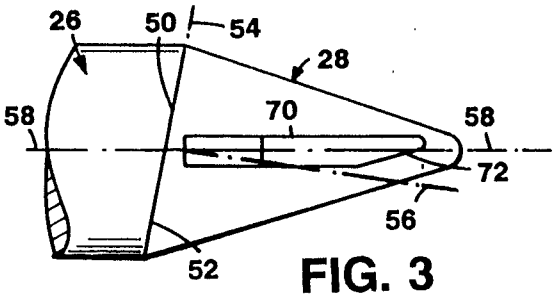
FIG. 3 is a left side view of the portion of the boring head shown in FIG. 2.
Figure 4:
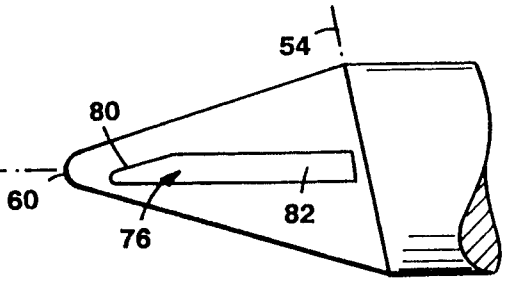
FIG. 4 is a right side view of the boring head shown in FIG. 2.

In another embodiment (shown in FIGS. 10–15), nose element 80 (which may be conical, cylindrical, or stepped as shown), is mounted on stub shaft 82 that has rotational axis 84 that is offset from mole axis 58'. Formed on base 86 are torque generating ramp grooves 90 (counterclockwise torque) and 92 (clockwise torque). Nose element 80 has three recesses 94, spaced about its periphery and lobe projections 96 between recesses 94. As in the embodiment shown in FIGS. 2–9, when straight ahead moling is desired, the mole body 22' and base 86 are rotated in the counterclockwise direction (as viewed in FIG. 11) as a unit relative to nose member 80 (which is engaged with the soil 12) by applying torsional force to air hose 30'. When the rotational stop is reached, the head configuration will be that of FIGS. 10–12 (with nose axis 98 coincident with tool axis 58') such that the mole 20' will advance straight ahead. Ramp groove 90 is exposed to the soil by recess 94B and generates sufficient counterclockwise torque on base 86 to keep the base 86 and nose 80 against their stops. The lead end of torque generating ramp groove 92 is blocked by lobe projection 96A. Switchover to the steered mode is accomplished by applying torsional force in the opposite direction to air nose 30' to rotate the base 86 180° relative to nose 80 to the position shown in FIGS. 13–15 in which nose axis 98 is parallel to and offset from tool axis 58' and nose 80 is in asymmetrical configuration relative to body 22' and tool axis 58'. Ramp groove 92 is exposed to the soil in this position and generates clockwise torque as the mole is advanced through the soil, while ramp groove 90 is obscured behind lobe projection 96A of nose element 80. Ribs can be employed on nose 80 to facilitate switch over between straight and curved boring modes and additional ramp grooves or similar structures may be provided on base 86 if desired.

While particular embodiments of the invention have been shown and described, other embodiments will be apparent to those skilled in the art, and therefore, it is not intended that the invention be limited to the disclosed embodiments, or to details thereof, and departures may be made therefrom within the spirit and scope of the invention.

What is claimed is:

1. Moling apparatus for forming a generally horizontal underground passage in soil for a utility conduit or the like comprising tool head structure that defines a tool axis, said tool head structure including a base portion and a nose portion mounted on said base portion, said base portion being rotatable relative to said nose portion between a first position in which said nose portion has surfaces which are in symmetrical position with respect to said tool axis and a second position in which said nose surfaces are in asymmetrical position with respect to said tool axis so that said tool will tend to move through soil along a generally straight portion when said nose portion is in said first position and will tend to move through soil along a curved path when said nose portion is in said second position in response to propulsion forces applied to said tool head structure, first surface structure for interacting with the soil in which said tool head structure is disposed to impart torque about said tool axis in a first rotational direction when said nose portion is in said first position and second surface structure for generating torque through interaction with the soil in the opposite rotational direction when said nose portion is in said second position.

2. The apparatus of claim 1 wherein said first and second surface structures are on said nose portion.

3. The apparatus of claim 1 wherein said first and second surface structures are on said base portion.

4. The apparatus of claim 1 wherein said first and second surface structures includes flange structures on said nose portion, said flange structures having leading edge portions inclined relative to said tool axis for interacting with soil to impart torque in one rotational direction when said nose and base portions are in said first position and having different projected areas when said nose and base portions are in said second position to impart torque in the opposite rotational direction when said nose and base portions are in said second position.

5. The apparatus of claim 1 wherein said first and second surface structures includes first and second sets of torque generating ramp surfaces on said base portion and said nose portion includes structure blocking said first set and exposing said second set in said first position and structure exposing said first set and blocking said second set in said second position.

6. The apparatus of claim 5 wherein said torque generating ramp surfaces are grooves.

7. The apparatus of claim 5 wherein each said set includes one ramp surface.

8. The apparatus of claim 1 wherein said nose portion is mounted on said base portion for rotation about a swash axis that is at an angle to said tool axis.

9. The apparatus of claim 8 wherein said first and second surface structures includes flange structures on said nose portion, said flange structures having leading edge portions inclined relative to said tool axis for interacting with soil to impart torque in one rotational direction when said nose and base portions are in said first position and having different projected areas when said nose and base portions are in said second position to impart torque in the opposite rotational direction when said nose and base portions are in said second position.

10. The apparatus of claim 1 wherein said nose portion is mounted on said base portion for rotation about an axis that is parallel to and offset from said tool axis.

11. The apparatus of claim 10 wherein said first and second surface structures includes first and second sets of torque generating ramp surfaces on said base portion and said nose portion includes structure blocking said first set and exposing said second set in said first position and structure exposing said first set and blocking said second set in said second position.

12. The apparatus of claim 1 and further including torsional force applying structure comprising elongated torsionally stiff structure connected to said tool head structure and adapted to extend to the surface of the soil in which said passage is to be formed.

13. The apparatus of claim 12 and further including pneumatically actuated impact structure, and said torsionally stiff structure is an air hose for supplying pressurized air to said impact structure.

14. The apparatus of claim 13 and further including operator controllable torque generating structure for applying torsional force to said air hose at the surface of the soil in which said passage is to be formed.

15. The apparatus of claim 1 and further including transmitter structure in said moling apparatus for supplying positional information to a point above the surface of the soil in which said passage is to be formed.

16. The apparatus of claim 15 wherein said nose portion is mounted on said base portion for rotation about a swash axis that is at an angle to said tool axis, and said first and second surface structures includes flange structures on said nose portion, said flange structures having leading edge portions inclined relative to said tool axis for interacting with soil to impart torque in one rotational direction when said nose and base portions are in said first position and having different projected areas when said nose and base portions are in said second position to impart torque in the opposite rotational direction when said nose and base portions are in said second position.

17. The apparatus of claim 16 and further including torsional force applying structure comprising a torsionally stiff air hose connected to said tool head structure and adapted to extend to the surface of the soil in which said passage is to be formed, pneumatically actuated impact structure, said air hose supplying pressurized air to said impact structure, and operator controllable torque generating structure for applying torsional force to said air hose at the surface of the soil in which said passage is to be formed.

18. The apparatus of claim 15 wherein said nose portion is mounted on said base portion for rotation about an axis that is parallel to and offset from said tool axis, said first and second surface structures includes first and second groove structures on said base portion and said nose portion includes structure blocking said first groove structure and exposing said second groove structure in said first position and structure exposing said first groove structure and blocking said second groove structure in said second position.

19. The apparatus of claim 18 and further including torsional force applying structure comprising a torsionally stiff air hose connected to said tool head structure and adapted to extend to the surface of the soil in which said passage is to be formed, pneumatically actuated impact structure, said air hose supplying pressurized air to said impact structure, and operator controllable torque generating structure for applying torsional force to said air hose at the surface of the soil in which said passage is to be formed.

* * * * *